US005619903A

United States Patent [19]

Rogers et al.

[11] Patent Number: 5,619,903

[45] Date of Patent: Apr. 15, 1997

[54] BRAIDED PREFORM FOR COMPOSITE BODIES

[75] Inventors: Charles W. Rogers, Fort Worth; Steven R. Crist, Arlington, both of Tex.

[73] Assignee: Bell Helicopter Textron Inc., Fort Worth, Tex.

[21] Appl. No.: 346,742

[22] Filed: Nov. 30, 1994

[51] Int. Cl.[6] ..... D04C 1/00

[52] U.S. Cl. ..... 87/7; 87/5; 87/6; 87/8; 87/9

[58] Field of Search ..... 87/1, 5, 6, 7, 8, 87/9

[56] References Cited

U.S. PATENT DOCUMENTS

| | | | |
|---|---|---|---|
| 2,602,766 | 7/1952 | Francis | 87/6 |
| 4,169,393 | 10/1979 | Wetzel et al. | 87/7 X |
| 4,519,290 | 5/1985 | Inman et al. | 87/7 |
| 4,719,837 | 1/1988 | McConnell et al. | 87/1 |
| 4,777,859 | 10/1988 | Plummer | 87/5 X |
| 4,847,063 | 7/1989 | Smith | 87/9 X |
| 4,902,297 | 2/1990 | Devanathan | 87/1 X |
| 4,983,240 | 1/1991 | Orkin et al. | 87/1 X |
| 5,016,516 | 5/1991 | Aldrich et al. | 87/8 |
| 5,070,914 | 12/1991 | Fukuta et al. | 87/8 X |
| 5,101,556 | 4/1992 | Fluga et al. | 87/7 X |
| 5,324,563 | 6/1994 | Rogers et al. | 428/114 |

OTHER PUBLICATIONS

G.E. Freger and N.A. Karvasarskaya "Calculation and Optimum Design of Composite Elements of rd Structures", pp. 376–381 Mechanics of Composite Materials (Russia), 1990.

*Primary Examiner*—William Stryjewski

*Attorney, Agent, or Firm*—Mark D. Perdue; Robert A. Felsman

[57] ABSTRACT

A braided member has a longitudinal axis and a plurality of braided strands of structural fiber. At least one elongate member having a rigidity greater than that of the strands of structural fiber is intertwined into the braided strands parallel to the longitudinal axis of the braided member. According to the preferred embodiment of the present invention, the structural fibers are selected from the group consisting of aramid, glass, and carbon fibers and the braided member is a triaxially braided tube. According to the preferred embodiment of the present invention, the elongate member is a pultruded rod having compressive strength approaching its tensile strength.

12 Claims, 2 Drawing Sheets

BRAIDED PREFORM FOR COMPOSITE BODIES

BACKGROUND OF THE INVENTION

1. Field of the Invention

The present invention relates generally to composite bodies or structures formed of structural fibers in a resin matrix. More specifically, the present invention relates to a braided fiber preform for use in composite molding processes that result in composite bodies or structures having improved strength characteristics.

2. Background Information

Composite materials consisting of fibers and a resin matrix are used to produce a wide range of useful products, from fiberglass sailboat hulls to the recent radar-transparent "Stealth" aircraft. Composite structures have a number of advantages, including strength-to-weight-ratios approaching or even surpassing those of the most advanced structural alloys.

Several processes or methods for forming composite bodies or structures are in conventional use. Generally, all of these methods involve the formation of a "layup" or preform of fibrous material, which generally takes the contours of the finished composite structure. This layup or preform may be formed of a fabric of structural fibers or individual fibers themselves, and may be "laid up" against a mandrel either manually or by a mechanized apparatus. One such method of forming a preform or composite bodies or structures is to braid a plurality of structural fibers about a mandrel. An example of this method is found in U.S. Pat. No. 4,519,290, May 28, 1985 to Inman et al., which discloses a braided preform fabrication for a refractory article such as an exit cone of a rocket motor nozzle.

One shortcoming of prior-art composite materials and structures, particularly those employing graphite fibers, is that the resulting composite structures have generally satisfactory tensile strength, but compressive strength that is only a fraction of the tensile strength. A recent improvement in composite structure technology is found in commonly assigned U.S. Pat. No. 5,324,563, Jun. 28, 1994 to Rogers et al., which discloses a pultruded rod of carbon fibers having an amplitude to length (A/L) ratio of less than 0.9% disposed in a matrix that is solidified or cured into a rigid form. The composite structure disclosed in this patent has a compressive strength that approaches its tensile strength and provides a vastly improved composite structure. However, due to the recency of this improvement, there are relatively few applications for this marked improvement in composite structure technology.

A need exists, therefore, for an improved preform for use in composite molding processes and the composite structures or bodies resulting therefrom that incorporates the recent advances in composite technology in which the compressive strength of composite bodies or structures approaches the tensile strength thereof.

SUMMARY OF THE INVENTION

It is a general object of the present invention to provide improved preform for use in a composite molding process to improve the strength characteristics of the composite bodies or structures resulting therefrom. This and other objects of the present invention are accomplished by a braided member having a longitudinal axis and a plurality of braided strands of structural fiber. At least one elongate member having a rigidity greater than that of the strands of structural fiber is intertwined into the braided strands parallel to the longitudinal axis of the braided member. According to the preferred embodiment of the present invention, the structural fibers are selected from the group consisting of aramid, glass, and carbon fibers and the braided member is a triaxially braided tube.

According to the preferred embodiment of the present invention, the elongate member is a pultruded rod formed of a plurality of substantially straight structural fibers disposed in a resin matrix and aligned linearly.

Other objects, features, and advantages of the present invention will become apparent with reference to the detailed description which follows.

DESCRIPTION OF THE PREFERRED EMBODIMENT

Figure 1:
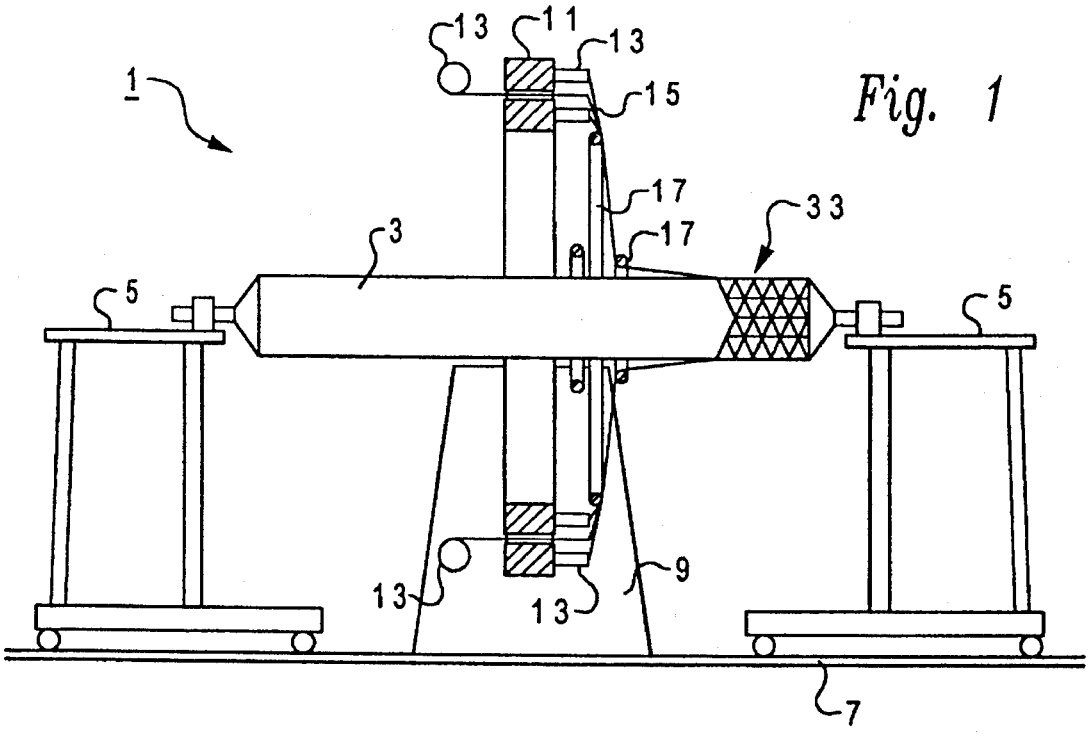
FIG. 1 is a schematic depiction of a braiding apparatus for forming the braided preform according to the present invention.

FIG. 1 is a schematic representation of a braiding apparatus 1 employed in the fabrication of braided preforms for use in composite molding processes. Braiding apparatus 1 comprises a mandrel 3, which is rigid and has an exterior surface generally conforming to the interior surface of the final composite body or structure that is to be formed employing the braided preform. Mandrel 3 is supported at each end by a pair of supports 5, which are slidably mounted on a track or rail 7 for translation of mandrel 3 and supports 5 relative to the remainder of braiding apparatus 1. A stationary support 9 is provided generally intermediate mandrel supports 5. A braiding ring 11 is mounted for rotation about mandrel 3 on support 9. A plurality of spools 13 of structural fiber are carried by braiding ring 11. At least a pair of guide rings 17 are supported by support 9 and serve to guide structural fiber 15 from spools 13 carried by braiding ring 11 onto mandrel 3 as braiding is accomplished.

In operation, braiding ring 11 rotates spools 13 about mandrel 3 and structural fiber 15 is dispensed from spools 13 and guided onto mandrel 3 by guide rings 17 to produce a triaxial braid 33 upon the exterior surface of mandrel 3, Mandrel 3 is translated relative to braiding ring 11 to extend triaxially braided preform 33 over the length of mandrel 3. The operation of braiding apparatus 1 is generally similar to conventional braiding techniques utilizing only structural fiber tows. The preferred braiding apparatus 1 is manufactured by Wardwell Braiding Machine Co. of Central Falls, R.I. and is modified by Fibre Innovations, Inc. of Norwood, Mass. to handle pultruded rods. The modifications principally concern adjustment of the dimensions of spools 13, guide rings 17, and related equipment to accommodate the larger minimum bend radius required by the increased rigidity of the elongate members or pultruded rods incorporated into preform 33, as described below.

Figure 2:
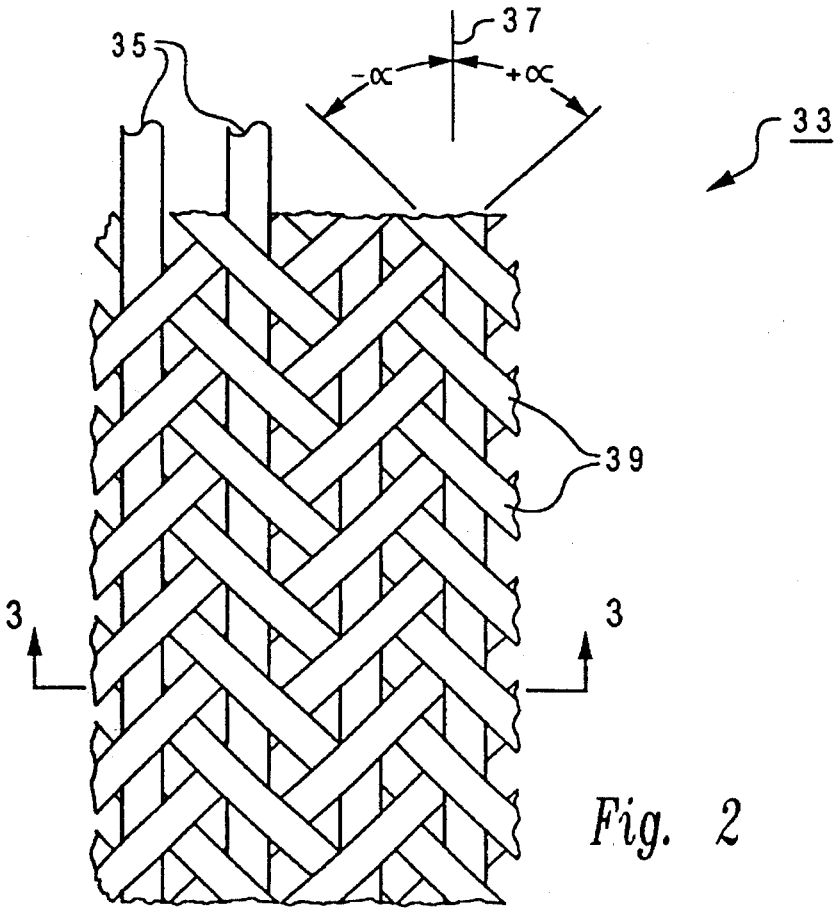
FIG. 2 is a fragmentary, enlarged view of a braided preform according to the present invention.

FIG. 2 is an enlarged elevation view of a braided fiber preform 33 according to the present invention. Braided preform 33 comprises a plurality of elongate members 35, which extend along a longitudinal axis 37 of preform 33. Longitudinal axis 37 generally corresponds to the longitudinal axis of mandrel 3 and serves as the angular datum (0 degrees) from which other angular dimensions of braided preform 33 are measured. A plurality of oblique braid strands 39 of structural fiber are braided or intertwined about elongate members 35 and intersect them at selected angles α. In conventional braided preforms, both elongate members 35 and braid strands 39 are formed of structural fibers. The structural fibers corresponding to elongate members 35 are referred to as "axial" tows, while fibers corresponding to braid strands 39 are referred to as "braid" or "oblique" tows.

According to the present invention, the conventional axial tows are replaced with elongate members 35, which have a rigidity and strength greater than the conventional fiber axial tows and braid strands 39. According to the preferred embodiment of the present invention, elongate members 35 are pultruded rods as described in U.S. Pat. No. 5,324,563, Jun. 28, 1994, which is incorporated herein by reference. These pultruded rods are formed of carbon or structural fibers aligned linearly with a degree of waviness defined by an average amplitude to length (A/L) ratio of less than 0.9% (determined by measuring the angularity distribution found in fiber alignment in a selected cross section of the rod) and are disposed in a matrix surrounding the fibers and cured into a rigid form, wherein pultruded rods 35 have a compressive strength approaching their tensile strength. Pultruded rods 35 thus lend their strength to preform 33 and to the composite body ultimately formed using pultruded rods 35.

According to the preferred embodiment of the present invention, braid strands 39 are formed of structural fiber selected from the group consisting of aramid, glass, and carbon fibers. Braid strands 39 are braided about and intertwined with elongate members 35 and intersect elongate members 35 at an angle α of 60°.

Figure 3:
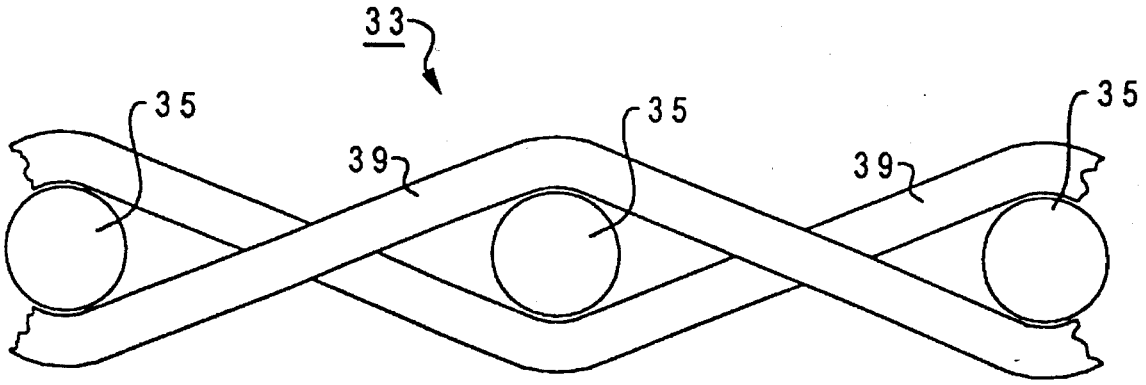
FIG. 3 is a cross-section view, taken along section line 3—3 of FIG. 2, of the braided preform according to the present invention.

FIG. 3 is a longitudinal section view, taken along section line 3—3 of FIG. 2, of braided member 33. Braid strands 39 are formed of carbon fiber 0.0135 inch in diameter and elongate member is a pultruded rod 0.028 inch in diameter. Elongate members 35 are spaced apart such that braid strands 39 form 60° angles about elongate members 35.

Figure 4:
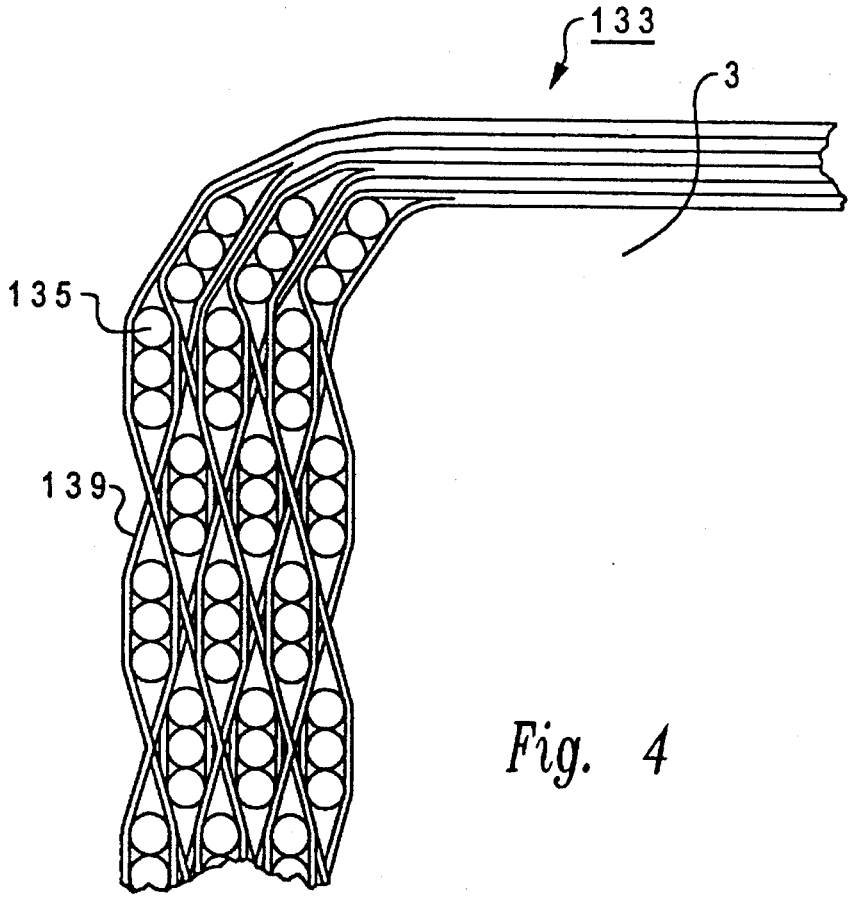
FIG. 4 is a cross-section view of another embodiment of the braided preform according to the present invention.

FIG. 4 is a cross-section view of another embodiment of a braided preform 133 according to the present invention. In this embodiment, mandrel 3 is generally square in cross section, and braiding is employed over only a portion of surface of mandrel 3. Additionally, three pultruded rods or elongate members 135 are grouped together between braid strands 139 of structural fiber. Furthermore, several (six are illustrated) braided layers are nested together to achieve a braided member 133 having a heavier section or increased thickness over a portion thereof. Otherwise, braided preform 133 is generally similar to that illustrated with reference to FIG. 2 and 3.

After braided preform 33, 133 is fabricated in braiding apparatus 1, mandrel 3, along with braided preform 33, 133, is removed from braiding apparatus 1 and is placed in a conventional composite molding apparatus (not shown). Braided preform 33, 133 then is impregnated and filled with structural resin in a conventional process. The resin is cured around braided preform 33, 133 and the entire assembly is removed from the molding apparatus and mandrel 3 to provide a composite body or structure, which may be further finished to final dimension. The resulting composite body or structure may take a number of different configurations, and the braiding parameters can be varied to obtain various strength characteristics in braided preform 33, 133 to obtain particular strength characteristics in different portions of the composite structure.

The braided preform according to the present invention possesses a number of advantages. A principal advantage is that composite structures having improved strength can be fabricated using the braided preform according to the present invention. Moreover, the braided preform according to the present invention is particularly well-suited to automated manufacture, thus eliminating costly manual layup of the preform. The braided structure is particularly well-suited for transferring loads applied to a composite structure to the elongate members or pultruded rods, which are stronger and more capable of bearing loads than the conventional strands of structural fiber. The braided preform according to the present invention does not employ cured or uncured resins in its fabrication, and thus has virtually infinite shelf life. Perhaps the most fundamental advantage of the preform according to the present invention is the improvement in structural reliability it provides. The rigid elongate member or pultruded rod virtually guarantees the proper alignment of the fibers therein throughout preform fabrication and subsequent processing of the preform into a finished part.

The invention has been described with reference to preferred embodiments thereof. The invention is thus not limited, but is susceptible to variation and modification without departing from the scope and spirit thereof.

We claim:

1. A braided preform for use in a composite molding process, the preform comprising:

a braided member having a longitudinal axis and a plurality of braided axial and oblique strands of structural fiber; and at least one elongate member having a rigidity greater than that of the strands of structural fiber, the elongate member replacing at least one of the axial strands and being intertwined into the braided strands parallel to the longitudinal axis of the braided member.

2. The braided preform according to claim 1 wherein the braided member is a triaxially braided tube.

3. The braided preform according to claim 1 wherein the elongate member is a pultruded rod formed of a plurality of substantially straight structural fibers disposed in a resin matrix and aligned linearly.

4. The braided preform according to claim 1 wherein the strands of structural fiber are selected from the group consisting of aramid, glass, and carbon fibers.

5. A braided preform for use in a composite molding process, the preform comprising:

a generally tubular braided member having a longitudinal axis and including:

a plurality of structural fiber axial strands extending through the braided member parallel to the longitudinal axis; and a plurality of structural fiber oblique strands braided around the axial strands; and at least one rod having a rigidity greater than that of the structural fiber strands, the rod replacing at least one of the axial strands and being intertwined into the braided member parallel to the longitudinal axis of the braided member.

6. The braided preform according to claim 5 wherein the braided member is a triaxially braided tube.

7. The braided preform according to claim 5 wherein the rod is formed of a plurality of substantially straight carbon fibers disposed in a resin matrix and aligned linearly with a specified maximum allowable degree of waviness to increase the compressive strength of the rod.

8. The braided preform according to claim 7 wherein the fibers of the rod are less wavy than an A/L ratio of 0.9 percent determined by measuring the distribution of angularity found in fiber alignment in a selected cross section of the rod.

9. The braided preform according to claim 5 wherein the structural fiber axial and oblique strands are selected from the group consisting of aramid, glass, and carbon fibers.

10. A braided preform for use in a composite molding process, the preform comprising:

a generally tubular, triaxially braided member having a longitudinal axis and including a plurality of structural fiber axial and oblique strands braided together; and at least one pultruded rod formed of a plurality of substantially straight structural fibers disposed in a resin matrix and aligned linearly with a specified maximum allowable degree of waviness to increase the compressive strength of the rod, the rod replacing at least one of the axial strands and being intertwined into the braided member parallel to the longitudinal axis of the braided member.

11. The braided preform according to claim 10 wherein the fibers of the pultruded rod are less wavy than an A/L ratio of 0.9 percent determined by measuring the distribution of angularity found in fiber alignment in a selected cross section of the rod.

12. The braided preform according to claim 10 wherein the structural fiber strands are selected from the group consisting of aramid, glass, and carbon fibers.

* * * * *